US006725932B2

(12) United States Patent
Taylor et al.

(10) Patent No.: US 6,725,932 B2
(45) Date of Patent: Apr. 27, 2004

(54) DOWN HOLE JAR TOOL

(76) Inventors: Mark A. Taylor, 104 Jennifer Cir., Houma, LA (US) 70360; Jeff L. Taylor, 100 Lynwood Dr., Houma, LA (US) 70360

( * ) Notice: Subject to any disclaimer, the term of this patent is extended or adjusted under 35 U.S.C. 154(b) by 0 days.

(21) Appl. No.: 10/143,709

(22) Filed: May 8, 2002

(65) Prior Publication Data

US 2003/0234121 A1 Dec. 25, 2003

(51) Int. Cl.[7] ..... E21B 31/107; E21B 31/113

(52) U.S. Cl. ..... 166/301; 166/178; 166/177.6; 166/374; 175/297

(58) Field of Search ..... 166/301, 178, 166/381, 177.6, 319, 374; 175/297, 296

(56) References Cited

U.S. PATENT DOCUMENTS 4,098,338 A * 7/1978 Perkins ..... 166/301
4,333,542 A 6/1982 Taylor
4,658,901 A * 4/1987 Alexander ..... 166/301
4,736,797 A * 4/1988 Restarick et al. ..... 166/301
4,844,157 A 7/1989 Taylor
4,846,273 A 7/1989 Anderson et al.
4,889,198 A 12/1989 Buck
4,919,219 A 4/1990 Taylor
5,007,479 A * 4/1991 Pleasants et al. ..... 166/178
5,022,473 A 6/1991 Taylor
5,069,282 A 12/1991 Taylor
5,085,479 A 2/1992 Taylor
5,170,843 A * 12/1992 Taylor ..... 166/301
5,219,027 A 6/1993 Taylor
5,236,038 A * 8/1993 Clemishire ..... 166/178
5,269,374 A 12/1993 Taylor
5,337,829 A 8/1994 Taylor
5,584,353 A * 12/1996 Chancey et al. ..... 175/297
5,673,754 A 10/1997 Taylor
5,906,239 A * 5/1999 Oettli ..... 166/178
5,931,242 A * 8/1999 Oettli ..... 175/296
6,481,495 B1 * 11/2002 Evans ..... 166/65.1

* cited by examiner

*Primary Examiner*—David Bagnell
*Assistant Examiner*—T. Shane Bomar
(74) *Attorney, Agent, or Firm*—Roy, Kiesel, Keegan & DeNicola

(57) ABSTRACT

The down hole jar tool is a tool used to apply jarring forces to objects that may be obstructing the path of a down hole, or above-ground operation that requires a repetitive jarring action to dislodge or remove such objects. The tool is used by providing a linear input to a mandrel portion that draws back against a compressible unit of predetermined resistance until a releasing means abruptly releases the mandrel portion. The mandrel portion then rapidly moves in the direction of the linear input until it encounters a stationary anvil, which produces the desired jarring action. This tool may also be combined with accelerators and/or valves, as well as other tools, to create a more substantial jarring impact.

6 Claims, 7 Drawing Sheets

DOWN HOLE JAR TOOL

BACKGROUND OF THE INVENTION

The present invention relates to downhole fishing and drilling operations, or removing obstructions to a drilling line when such a line becomes lodged or otherwise stuck in a well bore. Conventional means of downhole retrieval are dubious, and usually involve attempting to actuate the entire work string in the hope of dislodging it or removing an obstruction. Often this is unsuccessful either because the work string cannot jar loose the obstructions, or adequate motion cannot be effected in the well bore. Consequences of this failure to remove the obstruction can be failure of the well to produce at all or in part, also, current methods of removing obstructions can result in line breakage, both of which result in having to relocate the drilling operation, which necessarily involves lost time and money.

The present invention is able to attempt to actuate a lodged object in the path of the drilling path without moving the work string, which results in reduced trauma and friction and prevents work hardening of the work string. The tool can also have various other applications, such as drilling, retrieving or driving other tools that may be attached to it, or in any application, down hole or otherwise, that may require such a jarring action.

OBJECTS OF THE INVENTION

One objective of this invention is to provide a device capable of maintaining tensile force on a drilling work string while dislodging an object that may be interfering with the well operation.

Another objective of the invention is to provide a device that is more efficient at dislodging obstructions interfering with well operations.

Still another objective of the invention is to provide a device that can be placed into any confined space and perform a jarring action, or drive other tools that require linear input.

Other objects and advantages of this invention shall become apparent from the ensuing descriptions of the invention.

SUMMARY OF THE INVENTION

According to the present invention, the down hole jar tool is a tool used to apply jarring forces to objects that may be obstructing the path of a down hole, or above-ground operation that requires a repetitive jarring action to dislodge or remove such objects. The tool is used by providing a linear input to a mandrel portion that draws back against a compressible unit of predetermined resistance until a releasing means abruptly releases the mandrel portion. The mandrel portion then rapidly moves in the direction of the linear input until it encounters a stationary anvil, which produces the desired jarring action. This tool may also be combined with accelerators and/or valves, as well as other tools, to create a more substantial jarring impact.

DESCRIPTION OF THE DRAWINGS

The accompanying drawings illustrate an embodiment of this invention. However, it is to be understood that this embodiment is intended to be neither exhaustive, nor limiting of the invention. It is but one example of some of the forms in which the invention may be practiced.

DETAILED DESCRIPTION OF THE PREFERRED EMBODIMENT

Figure 1A:
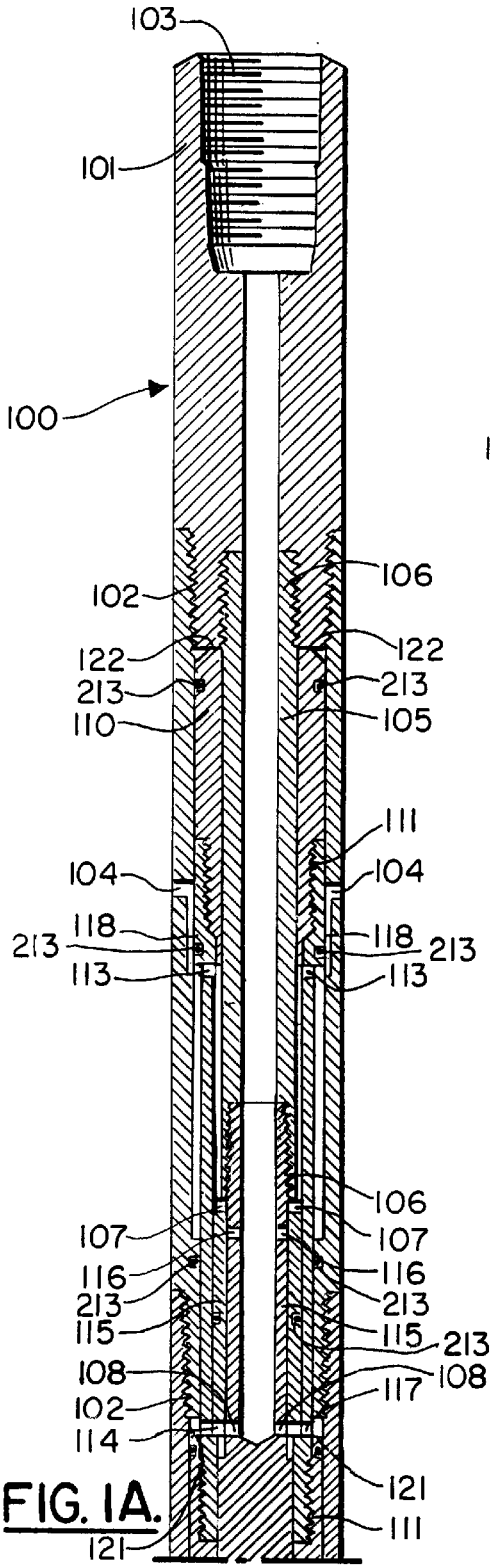
FIGS. 1A–1D show diametrical longitudinal cross-sections of the hammer assembly in the "up" or "fired" position.
Figure 1B:
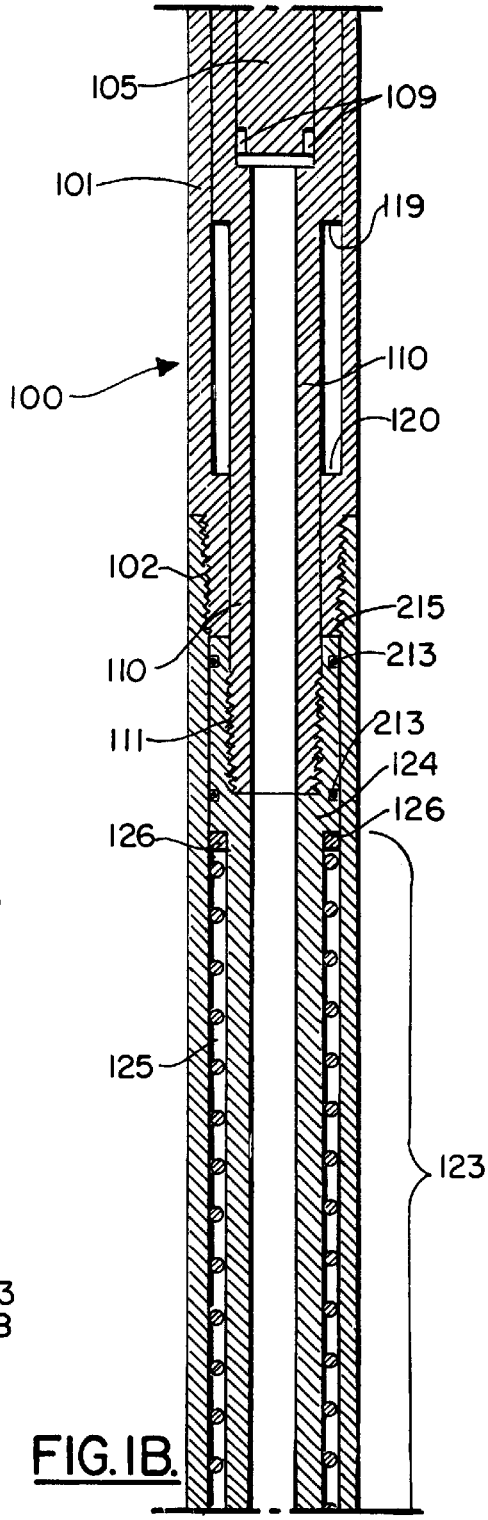
Figure 1C:
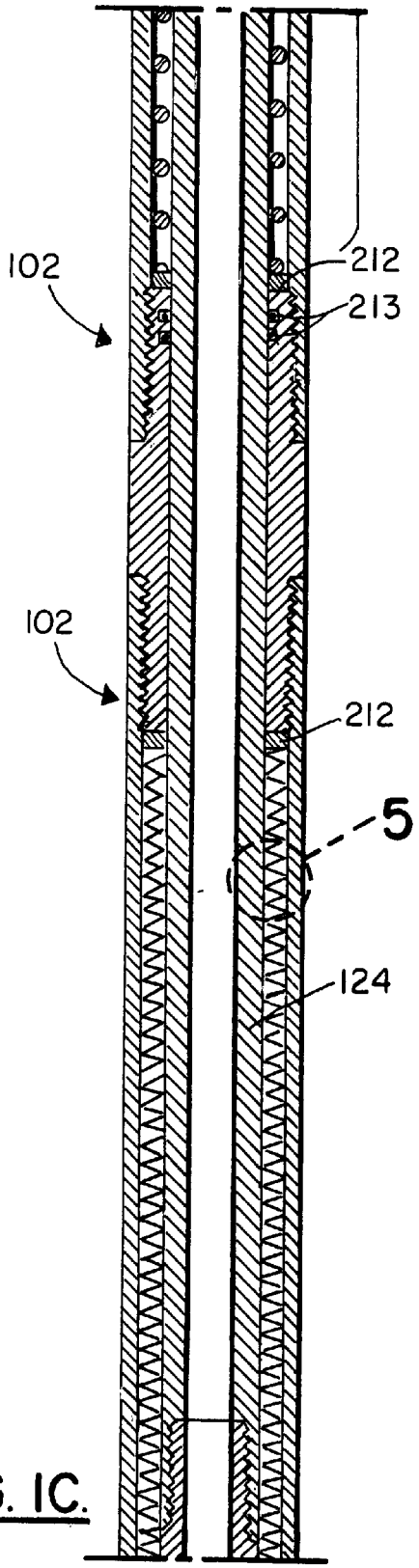
Figure 1D:
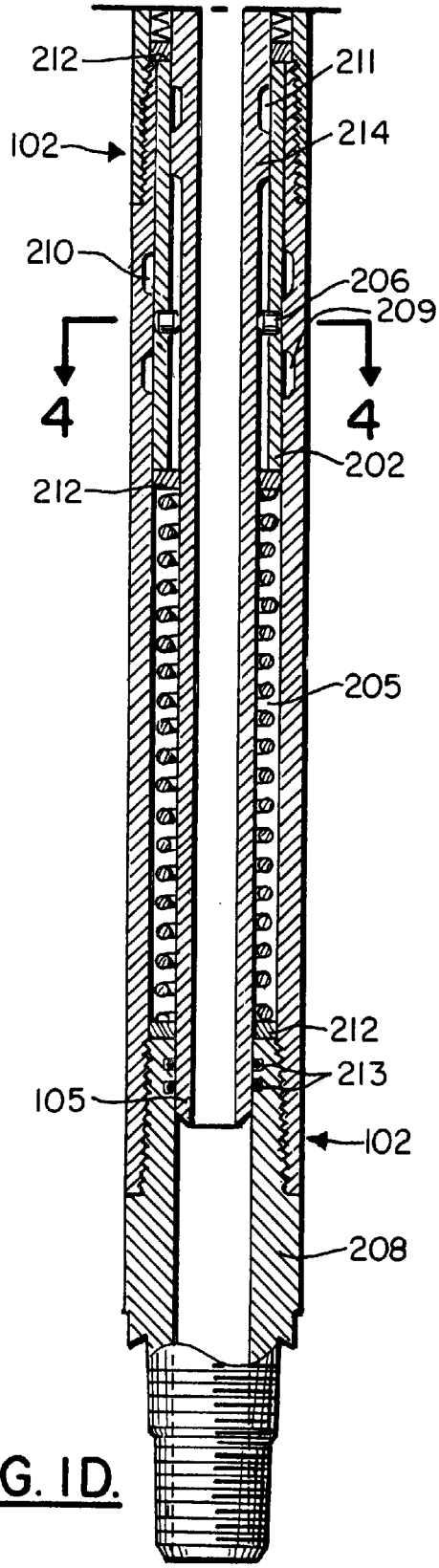

Without any intent to limit the scope of this invention, reference is made to the figures in describing the preferred embodiments of the invention. Referring to FIGS. 1 through 5, FIGS. 1A through 1D show the invention in the "up" or "fired" position. FIGS. 2A through 2D show the invention in the "down" or "re-cock" position, and FIGS. 3A through 3D show the invention in the "neutral" or "ready to fire" position.

The flow-activated hammer assembly 123 is comprised mainly of six components, outer mandrel 101, latching and unlatching sleeve 202, inner mandrel 105, kinetic energy sleeve 125, reloading energy sleeve 205, and latching and unlatching ring 206. Inner mandrel 105 resides within outer mandrel 101, and kinetic energy sleeve 125 is disposed between the two. Outer mandrel 101 is stationary, while inner mandrel 105 is free to move telescopically within outer mandrel 101.

Outer mandrel 101 can be a cylindrical housing used to contain all the parts of flow-activated hammer assembly 123. On the inner surface of outer mandrel 101, there will be re-cock groove 209 and firing groove 210. These grooves are shaped to receive latching and unlatching ring 206. The grooves can have various depths and shapes depending upon the characteristics of latching and unlatching ring 206.

Inner mandrel 105 is a cylindrical mandrel which at its uppermost end will be connected to a driving force, such as the flow-activated valve assembly 100 discussed below, or by any other linear input, be it mechanical or otherwise. Inner mandrel 105 can be hollow if used in conjunction with a hydraulic tool to permit hydraulic fluid to exit from such a tool, or it can be substantially solid if a mechanical means is used to drive the tool. Where inner mandrel 105 engages latching and unlatching sleeve 202, there is inner mandrel groove 211 cut to permit inner mandrel 105 to engage latching and unlatching ring 206. Shortly beyond inner mandrel groove 211, inner mandrel's 203 diameter decreases to permit accommodation of kinetic reloading sleeve 205 on its outside perimeter. This change in diameter forms retaining lip 214.

Figure 5:
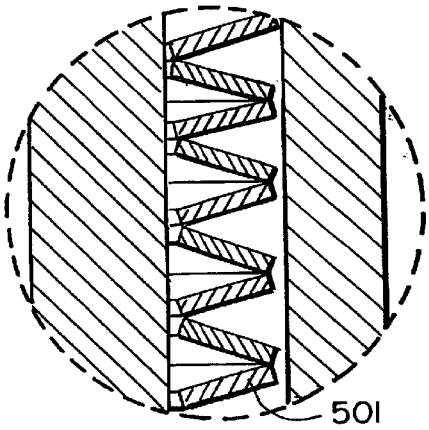
FIG. 5 shows an enlarged detail view of a portion of FIG. 1C.
Figure 5A:
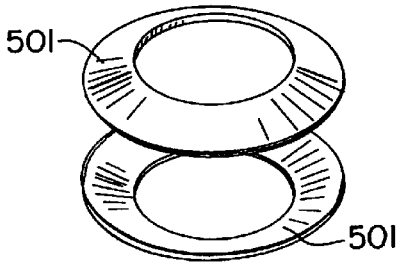
FIG. 5A shows a perspective view of the Belleville washers shown in FIG. 5.

Kinetic energy sleeve 125 is held in place radially by inner mandrel 105 and outer mandrel 101, and held in place longitudinally by outer mandrel coupling 206 which provides upper shoulder 207 and by latching and unlatching sleeve 202. Kinetic energy sleeve 125 can be any type of variably compressible substance or similar assembly, such as belleville washers, stacked chevron washers, springs, nitrogen gas or hydraulic fluid. An example of such a compressible assembly is shown in FIGS. 5 and 5A, where belleville washers 501 are stacked in a manner used to create kinetic energy, namely, face-to-face.

Latching and unlatching sleeve 202 is also held in place radially by outer mandrel 101 and inner mandrel 105, and secured longitudinally by kinetic energy sleeve 125 and by reloading energy sleeve 205. Latching and unlatching sleeve 202 is designed such that latching and unlatching ring 206 can be secured at a selected point along latching and unlatching sleeve's 202 length.

Figure 4B:
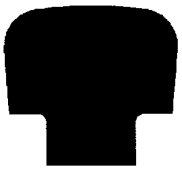
FIG. 4B shows an elevational view of the mushroom-shaped segments.
Figure 4:
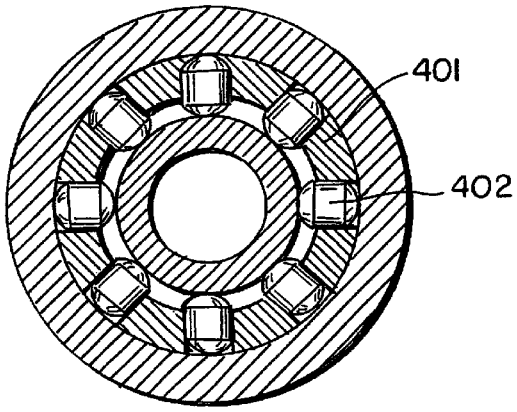
FIG. 4 shows an end cross-sectional view of the bearing assembly shown in FIG. 1D.
Figure 4A:
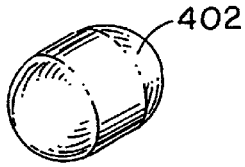
FIG. 4A shows a perspective view of the bearings shown in FIG. 4.

Examining FIG. 4, latching and unlatching ring 206 is comprised of a retaining ring 401, as well as bearings 402, which can either be in a capsule shape, or that of a cylinder with rounded edges, as in FIG. 4A, or in a "mushroom" shape, depending upon application.

Reloading energy sleeve 205, like the previous two components, is mounted between outer mandrel 101 and inner mandrel 105. Longitudinally, it is secured by latching and unlatching sleeve 202, and by an outer mandrel finisher 208. Reloading energy sleeve 205 can be any type of variably compressible substance or similar assembly, such as belleville washers, stacked chevron washers, springs, nitrogen gas or hydraulic fluid.

Washers 212 may be implemented at various points between moving parts to reduce friction and/or wear, and o-rings 213 can be used at strategic points to keep the insides of the tool clean, and/or prevent fluid from entering portions of the tool if needed.

In operation, a driving force will be applied to extending mandrel 124, such that extending mandrel 124 will be pulled upward, at which point latching and unlatching ring 206 will be located in inner mandrel groove 211 and will be unable to move past retaining lip 214, thus restricting movement of extending mandrel 124. As force is maintained on extending mandrel 124, retaining lip 214 and latching and unlatching ring 206 will begin to travel upward against the force of kinetic energy sleeve 125. The tool will now be in the "ready to fire" position, illustrated by FIGS. 3A through 3D.

This force will continue until sufficient energy is applied to extending mandrel 124 to overcome the configured strength of jar energy sleeve 204, at which point jar energy sleeve 204 will permit a small amount of longitudinal travel of latching and unlatching sleeve 202, causing latching and unlatching ring 206 to locate in firing groove 210. At this time, extending mandrel 124 will no longer be restricted in longitudinal movement by latching and unlatching ring 206 and retaining lip 214, and will rapidly move upward, until it strikes a aft inner shoulder 215, causing an upward jarring force on the tool, and leaving the tool in the "fired" position, as illustrated in FIGS. 1A through 1D.

After this upward jar is delivered, the tool will begin to return downward to the starting position. As it does, the retaining lip 214 will encounter latching and unlatching ring 206, moving it out of firing groove 210 and down the body of the tool, until it reaches re-cock groove 209. Here, latching and unlatching ring 206 will drop into re-cock groove 209, permitting retaining lip 214 to move past it. Now, reloading energy sleeve 205 will apply predetermined upward force, typically less than that of kinetic energy sleeve 125, but sufficient to move latching and unlatching ring 206 forward in re-cock groove 209. Extending mandrel 124 then begins moving upward again, and latching and unlatching ring will engage inner mandrel groove 211, thus beginning the firing stroke, illustrated in FIGS. 2A through 2D.

The tool, in the aforementioned embodiment, will apply an upward jarring force when operating; however, it may also be configured to provide a downward jarring force if needed. This may be accomplished by reconfiguring the kinetic energy sleeve 125 and reloading energy sleeve 205 to provide upward resistance instead of downward resistance, thereby causing the jarring force to impact in the reverse direction from that illustrated above.

This tool is also intended to be used in conjunction with a flow-activated valve, such as the one in co-pending application entitled "Flow-Activated Valve," which is hereby incorporated by reference in its entirety. Such a tool would be attached as the driving force of the jar tool by being attached to extending mandrel 124. The flow-activated valve is described below.

Figure 2A:
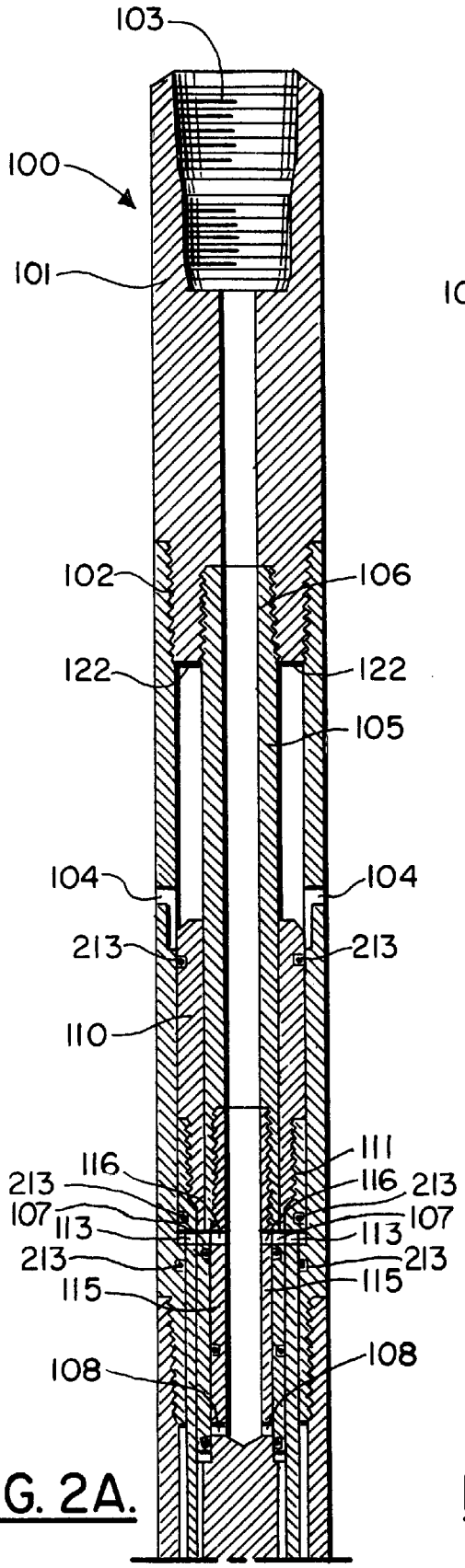
FIGS. 2A–2D show diametrical longitudinal cross-sections of the hammer assembly in the "down" or "re-cock for firing" position.
Figure 2B:
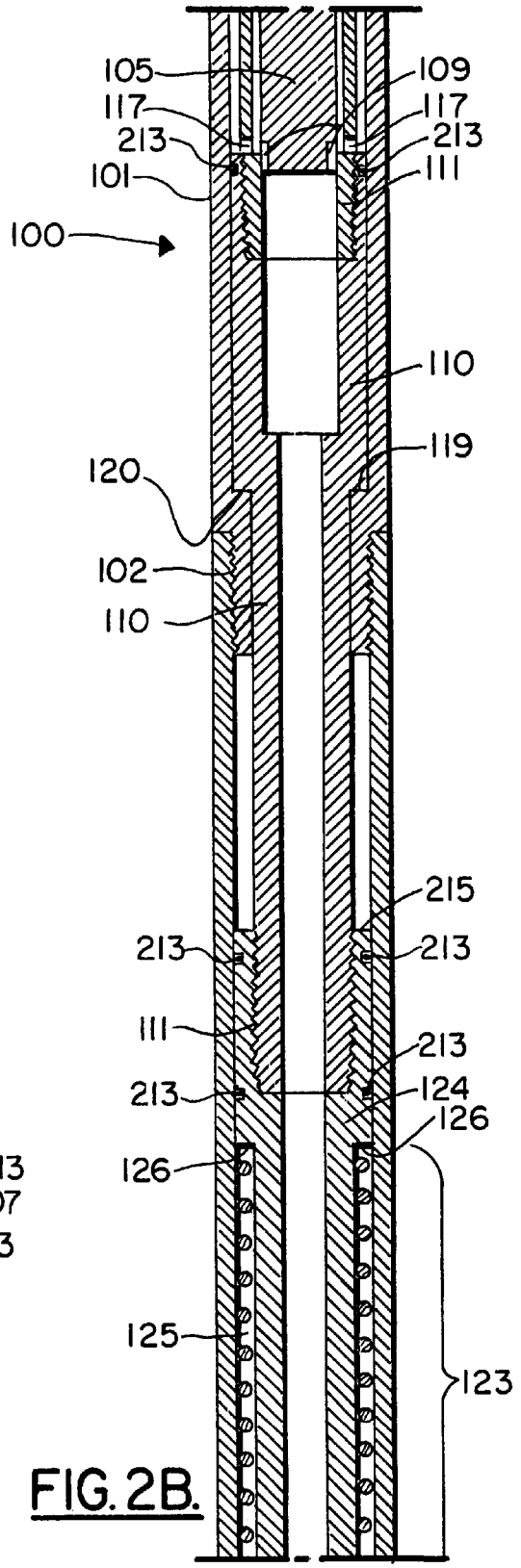
Figure 2C:
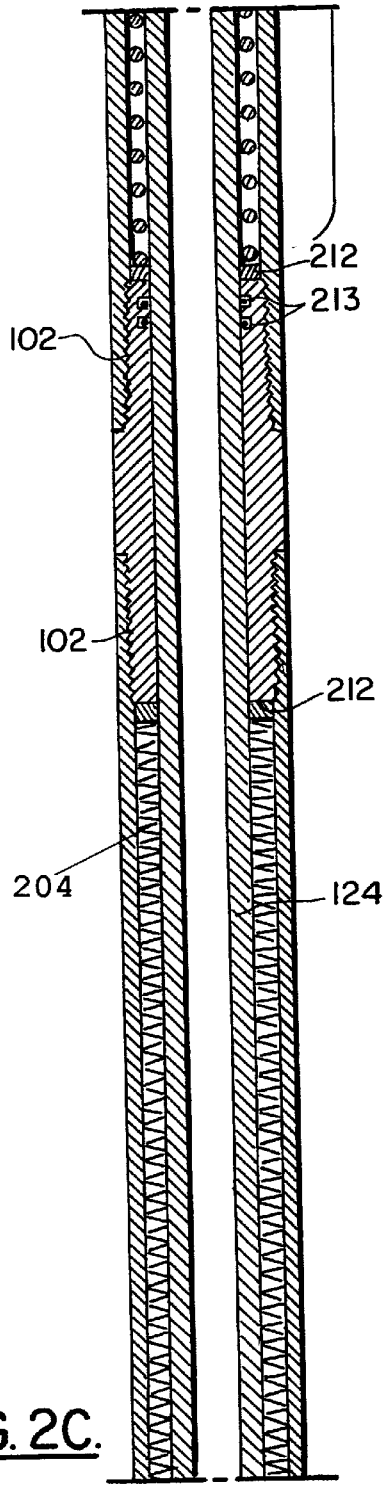
Figure 2D:
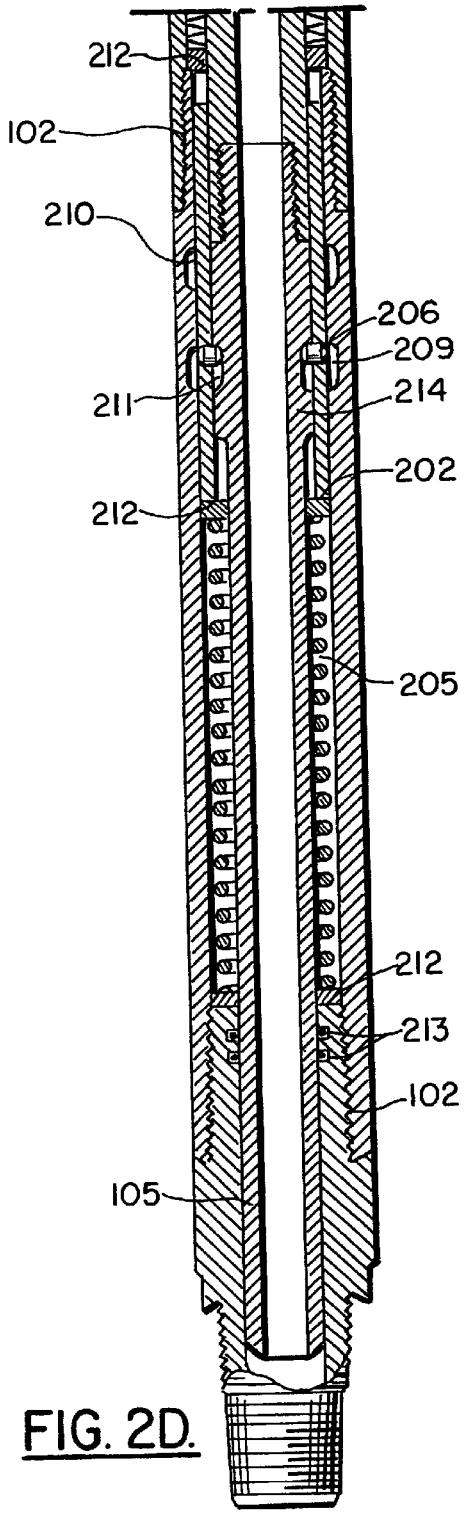
Figure 3A:
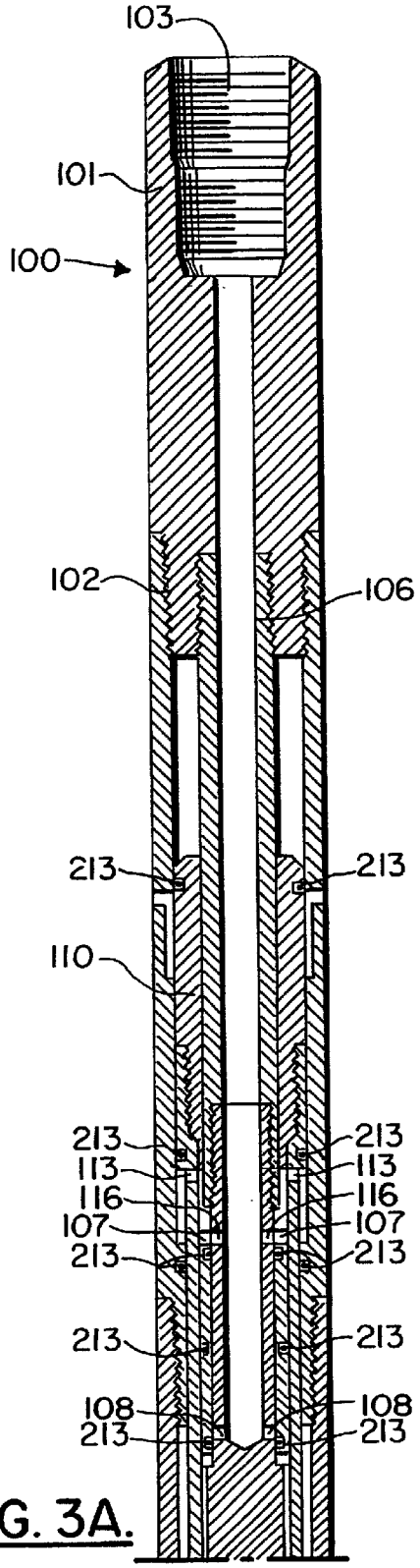
FIGS. 3A–3D show diametrical longitudinal cross-sections of the hammer assembly in the "neutral" or "ready to fire" position.
Figure 3B:
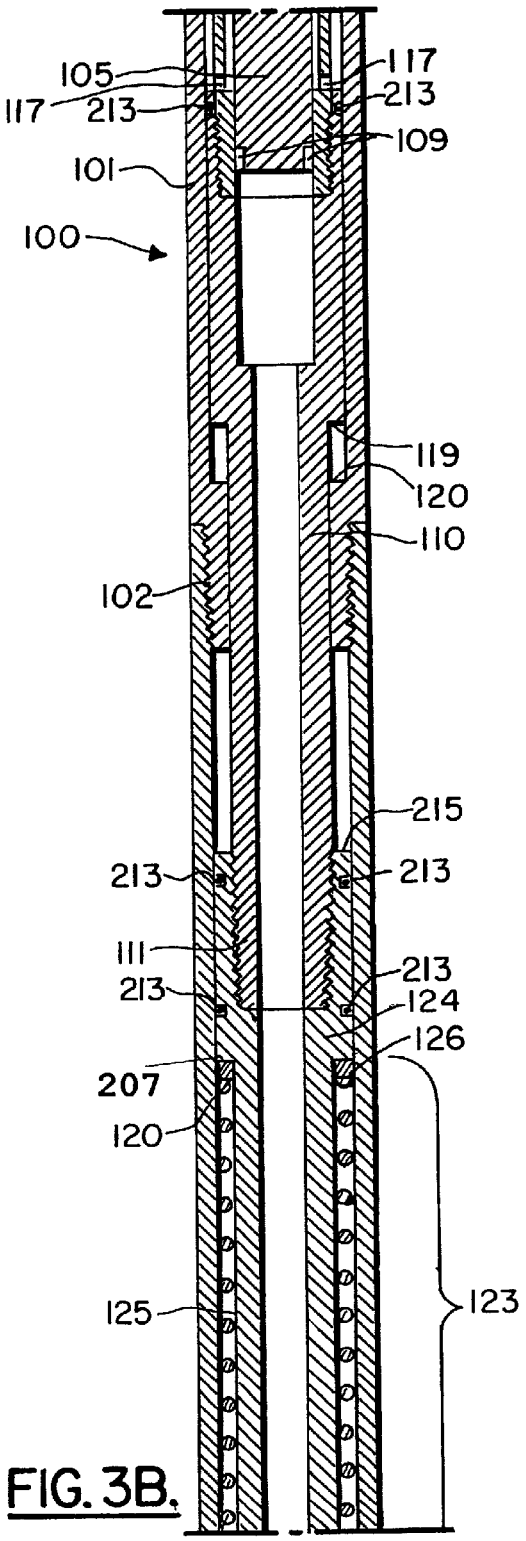
Figure 3C:
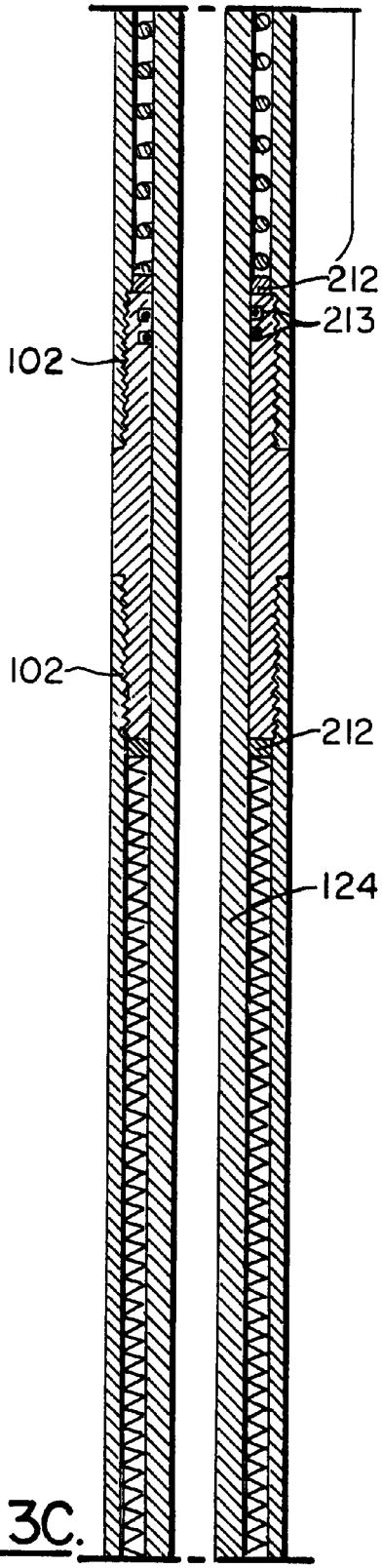
Figure 3D:
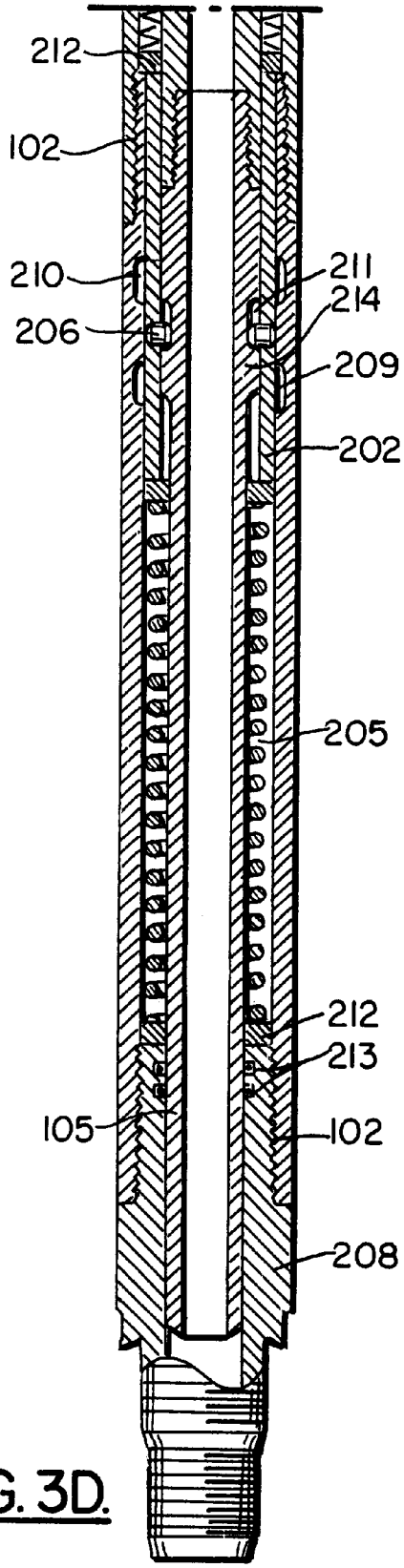

The "top" of tool assembly 100 starts at the top of FIGS. 1A, 2A, and 3A. Shown is outer mandrel 101, which in the embodiment of the above-mentioned FIGS., is threadably separable into several parts to facilitate assembly and maintenance by way of several threaded joints 102. The tool assembly 100 is shaped to permit connection to a hydraulic source and/or other threaded tool at joint 103. Outer mandrel 101 also has hydraulic exhaust ports 104. Located within outer mandrel 101 is the inner mandrel 105, which, in this embodiment, is threadably attached to outer mandrel 101 and is separable into parts by way of threaded connections 106. Inner mandrel 105 has hydraulic fore exhaust ports 107 and aft exhaust ports 108. Hydraulic fluid is also able to exhaust at the lower end of inner mandrel 105 through mill slots 109. These parts are all stationary while the tool is being operated.

Some of the parts of tool assembly 100 are moving while tool assembly 100 is operated, the first of which is reciprocating valve 110. Like outer mandrel 101 and inner mandrel 105, reciprocating valve 110 has, in the embodiment shown, been cast as separable pieces joined by threadable connections 111. Reciprocating valve 110 has fore hydraulic exhaust ports 113 and aft hydraulic exhaust ports 114. Various shoulders are along reciprocating valve 110 and its path of travel, such as aft hammer shoulder 119, which engages fore inner shoulder 120 of outer mandrel 101 on the down stroke. There also exists a reciprocating sleeve closing shoulder 118, and a reciprocating sleeve opening shoulder 121 which is used to actuate reciprocating sleeve 115 during operation. Outer mandrel 101 has a top shoulder 122 where outer mandrel 101 joins inner mandrel 105. Another moving part, reciprocating sleeve 115 is mounted to engage the outer portion of inner mandrel 105, and to slide back and forth along a small portion of inner mandrel 105. As in reciprocating valve 110, reciprocating sleeve 115 has fore hydraulic exhaust ports 116 and aft hydraulic exhaust ports 117.

It should be recognized that various threadable connections 111, while shown, are not essential for proper operation, and the invention can be practiced with or without threadable connections 111 on reciprocating valve 110, outer mandrel 101, or inner mandrel 105. Parts may be cast in fewer or more pieces, depending upon need and adoption for a particular use. In any embodiment, o-rings 213 may be strategically placed throughout the tool to prevent fluid or other materials that may be passing through or around the tool from entering moving part areas of the tool.

During operation, driving fluid, such as hydraulic fluid, gas or similar is pumped or otherwise introduced into tool assembly 100 at joint 103. The fluid then passes within outer mandrel 101, to inner mandrel 105, and while tool assembly 100 is in the "up" position, the fluid will exit via aft hydraulic ports 108 of inner mandrel 105, aft hydraulic ports 114 of reciprocating sleeve 115 and aft hydraulic ports 117 of reciprocating valve 110, at which point the fluid will force reciprocating valve 110 to move away from the "top" of tool assembly 100. Eventually, reciprocating valve 110 will engage aft hammer shoulder 119, creating an impact in the downward direction, as well as marking the end of the downward stroke.

Simultaneously with the above action, reciprocating sleeve opening shoulder 121 of reciprocating valve 110, as it slides, will cause reciprocating sleeve 115 to move down the inner mandrel 105 in the same direction, effectively closing aft hydraulic ports 108 of inner mandrel 105, and opening fore hydraulic ports 107 of inner mandrel 105. At this time, the fluid will be permitted to exit via the lower end of inner mandrel 105 through mill slots 109, at which point it may exit from end 122. This leaves tool assembly 100 in the "down" position.

At all times during operation, additional fluid is being pumped into joint 103, but because inner mandrel 105 hydraulic aft exhaust ports 108 are now closed, the fluid exits through the inner mandrel 105 hydraulic fore exhaust ports 107, which forces reciprocating valve 110 to move in the direction of joint 103 due to fluid pressure being applied to reciprocating valve 110, that being the path of least resistance. This movement continues until reciprocating valve 110 reaches top shoulder 122, at which point reciprocating valve 110 engages top shoulder 122 and creates an impact in an upward direction, marking the end of the upward stroke. At this point, reciprocating valve 110 will have traveled far enough to expose outer mandrel's 101 hydraulic exhaust ports 104 so that fluid will exit tool assembly 100. When reciprocating valve 110 is in this position, reciprocating sleeve closing shoulder 118 will have moved reciprocating sleeve 115 to its original, or "up" position, thus restarting the cycle.

To assist in the down hole operation, accelerator 123 may be attached to bottom end of tool assembly 100 in order to exaggerate the vibratory motion created by tool assembly 100. Accelerator 123 is constructed of extending mandrel 124, which is shaped to fit within outer mandrel 101, but also to permit a compressible kinetic energy sleeve 125 to fit between the walls of outer mandrel 101 and extending mandrel 124, and further be connected to reciprocating valve. Kinetic energy sleeve 125 is retained in place by being situated between a fore accelerator shoulder 126 and an aft accelerator shoulder 127.

In this manner, when reciprocating valve 110 is performing a downward stroke, it is energizing a compressible kinetic energy sleeve 125, such as a spring, belleville washer assembly, stacked chevron washer assembly, risked washer springs, hydraulic fluid or other known similar devices. This is accomplished when fore accelerator shoulder 126 is moving downwardly and compresses kinetic energy sleeve 125. When reciprocating valve 110 reverses direction, it is thrust forward with the contained kinetic energy stored in compressible kinetic energy sleeve 125, thus creating a more powerful impact on the upstroke. Similarly, compressible kinetic energy sleeve 125 can be configured to have the reverse effect, or to amplify the downward stroke. This can be done by reversing compressibility of the spring to change the direction of the release of kinetic energy.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A down hole jar tool comprising:

a. an outer mandrel having a shoulder means, said outer mandrel also shaped to form a firing groove and a re-cock groove along the surface of its inner diameter and forming a bridge therebetween, b. a kinetic energy sleeve being disposed within said outer mandrel said sleeve positioned to be initially radically restrainable by said bridge, said firing groove and re-cock groove used to operatively engage and disengage said sleeve, c. an inner mandrel adapted to be in mechanical communication with a driving means said inner mandrel shaped to fit within said outer mandrel and to form a latching shoulder, and said inner mandrel adapted to operatively engage said shoulder to impart an upward jarring force upon said down hole jar tool, d. said kinetic energy sleeve shaped to operatively engage outer surface of said inner mandrel, being disposed between said shoulder means and a sleeve, and having an upward force communication with said sleeve, e. a reloading energy sleeve shaped to operatively engage to said outer surface of said inner mandrel and exert upward axial force on said sleeve, and f. a ring, comprising a plurality of capsule segments disposed in a generally circular arrangement and being supported in substantially immovable relation with said inner mandrel and being positioned for contact by said sleeve, in a manner that upon predetermined application of downward force to said outer mandrel and said kinetic jar energy sleeve, said firing groove being moved downwardly into registry with said sleeve to permit radial expansion of said sleeve into said firing groove and rapid downward jarring movement of said inner mandrel against said outer mandrel by said kinetic energy sleeve against said inner mandrel, and upon application of predetermined upward force to said outer mandrel and reloading energy sleeve with said sleeve in its fired condition said re-cocking groove moving upwardly into registry with said sleeve, to permit radial expansion of said sleeve into said re-cocking groove and permitting upward movement of said sleeve past said ring to the cocked position thereof.

2. The down hole jar tool of claim 1 wherein said capsule segments are replaced with mushroom-shaped segments.

3. The down hole jar tool of claim 1 wherein said inner mandrel is shaped to permit any fluid to flow within it.

4. The down hole jar tool of claim 1 further comprising a flow-activated valve with which to drive said down hole jar tool, comprising:

a. an outer mandrel adapted to be operatively engaged to provide mechanical communication with a work string;

b. a reciprocating valve shaped to fit within said outer mandrel;

c. an inner mandrel shaped to fit within said reciprocating valve and operatively engaged on one end to said outer mandrel in order to maintain relative position to said outer mandrel; and d. a reciprocating sleeve shaped to engage a portion of the surface forming the outer diameter of said inner mandrel.

5. The method of exerting a vibratory force to any obstruction via a down hole tool using a down hole jar tool according to claim 1 comprising:

attaching said down hole jar tool to a driving input;

placing said down hole jar tool against an obstruction; and actuating said down hole jar tool with said driving input.

6. The method of claim 5 further comprising the step of using a flow-activated valve comprising an outer mandrel adapted to be operatively engaged to provide mechanical communication with a work string, a reciprocating valve shaped to fit within said outer mandrel, an inner mandrel shaped to fit within said reciprocating valve and operatively engaged on one end to said outer mandrel in order to maintain relative position to said outer mandrel, and a reciprocating sleeve shaped to engage a portion of the surface forming the outer diameter of said inner mandrel to drive said down hole jar tool.

* * * * *